US005382131A

United States Patent [19]

Werthmann

[11] Patent Number: 5,382,131

[45] Date of Patent: Jan. 17, 1995

[54] TOOL FOR MANIPULATING HEAVY OBJECTS

[76] Inventor: Paul E. Werthmann, 530 Alyce La., Aurora, Ill. 60505

[21] Appl. No.: 974,717

[22] Filed: Nov. 12, 1992

[51] Int. Cl.[6] ..... B66F 11/00

[52] U.S. Cl. ..... 414/684.3; 212/166; 254/131; 294/97; 294/82.13; 414/910; 414/911

[58] Field of Search ..... 414/591, 684.3, 910, 414/911; 294/91, 94, 96, 82.11, 82.13; 269/208; 254/131, 132; 280/47.24, 46; 212/166

[56] References Cited

U.S. PATENT DOCUMENTS

| | | | |
|---|---|---|---|
| 682,647 | 9/1901 | Scullin | 280/47.24 X |
| 2,615,839 | 4/1954 | Beasley | 269/208 |
| 4,359,241 | 11/1982 | Kistner | 294/82.13 |
| 4,662,607 | 5/1987 | Mochizuki et al. | 254/131 |

FOREIGN PATENT DOCUMENTS

| | | | |
|---|---|---|---|
| 938372 | 9/1948 | France | 280/47.24 |
| 572437 | 2/1976 | Switzerland | 294/82.13 |
| 2060557 | 5/1981 | United Kingdom | 280/47.24 |

*Primary Examiner*—Donald W. Underwood
*Attorney, Agent, or Firm*—Augustus G. Douvas

[57] ABSTRACT

A carriage supported tool for manipulating a heavy object including a mobile carriage assembly having a carriage supported on wheels, an elongated operating arm, and an elongated clamp-assembly support boom. Both the boom and the arm are attached to the carriage to form a lever with the carriage acting as a fulcrum. The clamp assembly is coupled to the boom by a chain and hook. The clamp assembly includes a plurality of adjustable jaw sets for engaging a heavy object, such as a manhole frame, which is to be moved.

5 Claims, 4 Drawing Sheets

TOOL FOR MANIPULATING HEAVY OBJECTS

BACKGROUND OF THE INVENTION

This invention relates to a mobile tool which enables a single human operator to lift, move, and lower heavy objects without the use of an auxiliary power source.

In many construction situations an object weighing several hundred pounds must be moved to a new location. If a power-driven mechanism is not available to perform the task, it must be done manually. This may require the manual capabilities of several workers; and if they are not readily available, a single laborer may attempt to lift and move the heavy object incurring substantial risk to his well being.

A particular construction task, by way of example, all too often involving excessive manual moving relates to the placement and removal of heavy manhole frames on or off of manholes. These frames can weigh in excess of three-hundred pounds, and quite often result in job-site injuries during these operations when manual effort is relied upon solely for moving and lifting.

STATEMENT OF THE INVENTION

Accordingly, a principal object of this invention relates to a simple manually-driven tool which will enable a single human operator to manipulate safely and easily a heavy object.

Another object is to provide such a tool which enables the operator to handle a manhole frame weighing several hundred pounds.

A preferred embodiment of my tool includes a mobile carriage assembly having a carriage supported on wheels, an elongated operating arm, and an elongated clamp-assembly support boom. Both the boom and the arm are attached to the carriage to form a lever with the carriage acting as a fulcrum. The clamp assembly is coupled to the boom by a chain and hook. The clamp assembly has a plurality of adjustable jaw sets for engaging a heavy object, such as a manhole frame, which is to be moved.

DESCRIPTION OF THE DRAWINGS

In order that all of the structural features for attaining the objects of this invention may be readily understood, reference is made to the drawings in which.

DESCRIPTION OF THE PREFERRED EMBODIMENT

Figure 1:
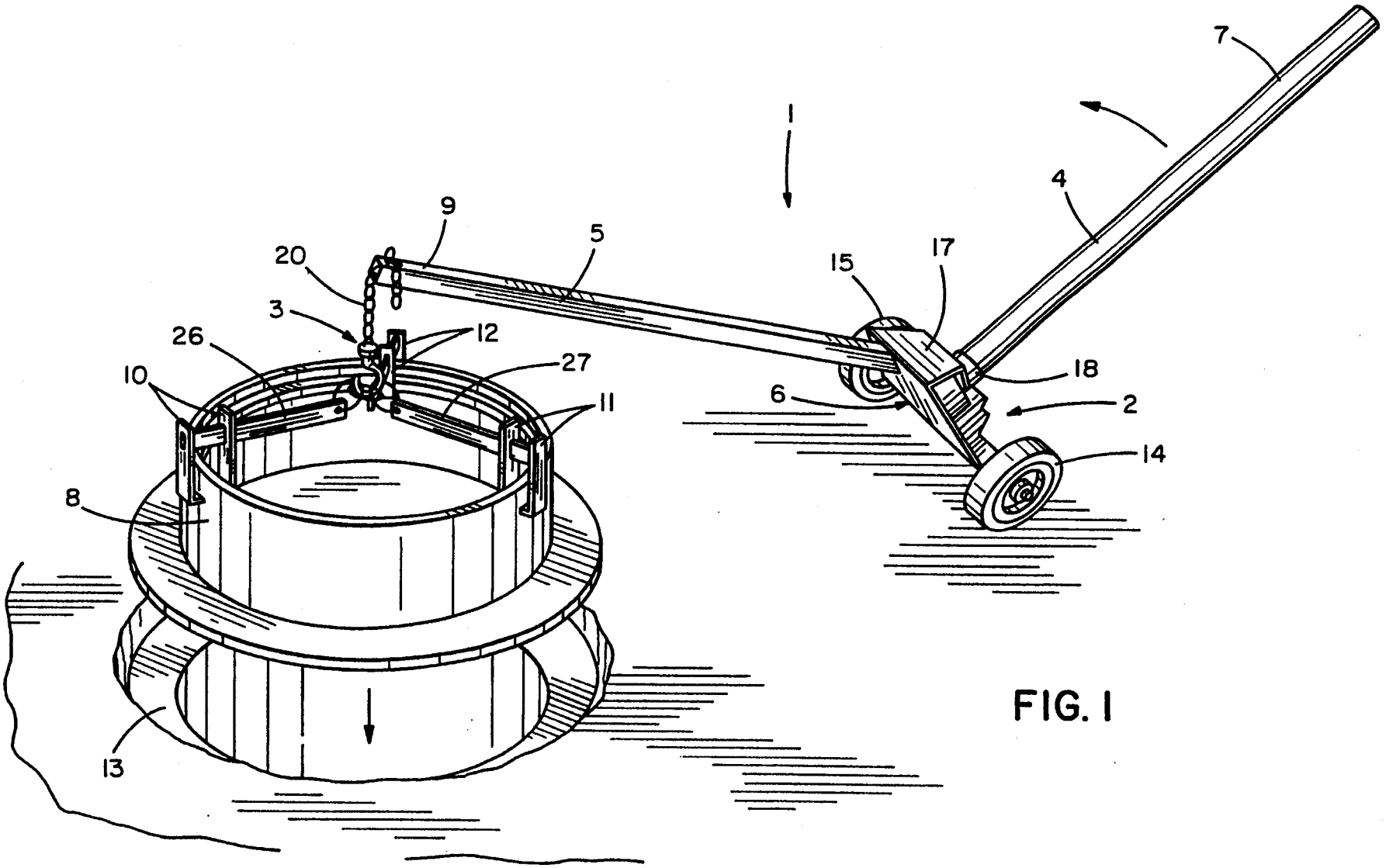
FIG. 1 is a perspective view of the carriage and clamp assemblies of this invention lowering a heavy manhole frame into place on a manhole.

A preferred embodiment of tool 1 of my invention is shown in the drawings. Tool 1 comprises as its principal components a carriage assembly 2 and a clamp assembly 3 (FIG. 1). The carriage assembly, which includes operating arm 4 and boom 5 attached to wheeled carriage 6, serves as a lever with carriage 6 acting as a fulcrum moveable on a generally horizontal surface.

Figure 2:
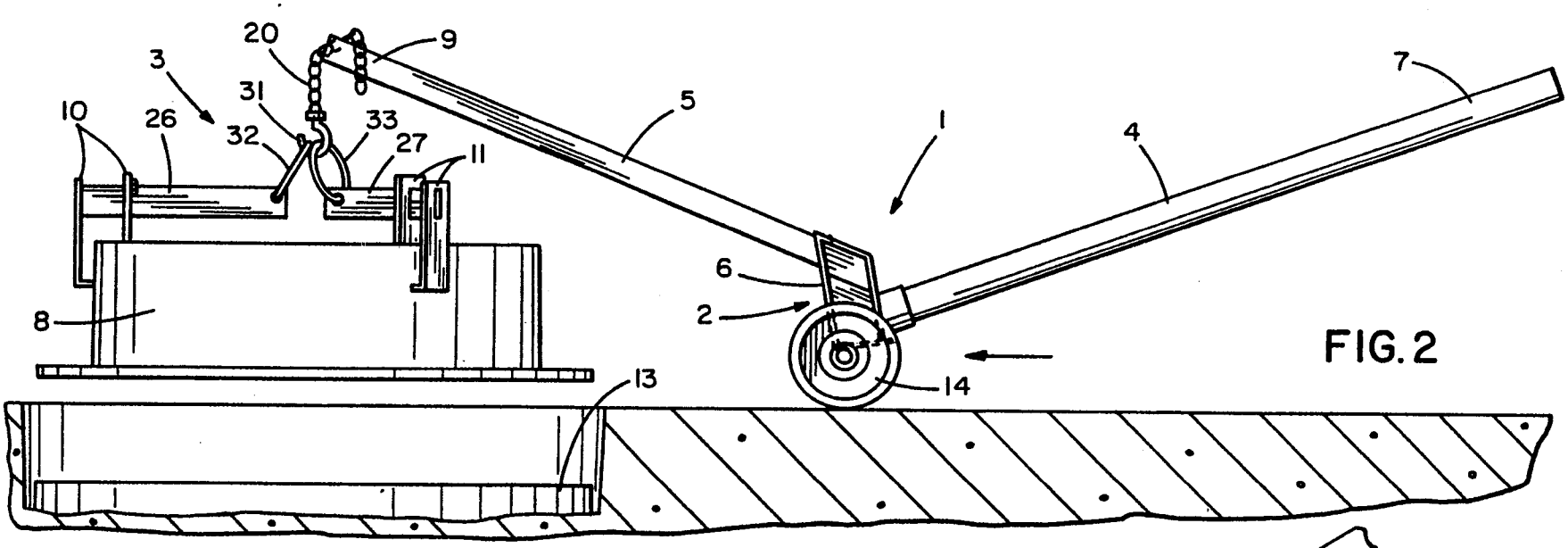
FIG. 2 is a side elevation view of the structure of FIG. 1.

Tool 1 is designed to enable a human operator grasping the projecting end 7 of operating arm 4 to move easily a heavy object, such as a manhole frame 8 (FIG. 2). Clamp assembly 3 is attached to the projecting end 9 of boom 5, and the three identical jaw sets 10, 11 and 12 clamp upon the cylindrical sidewall 13 of manhole frame 8.

Figure 3:
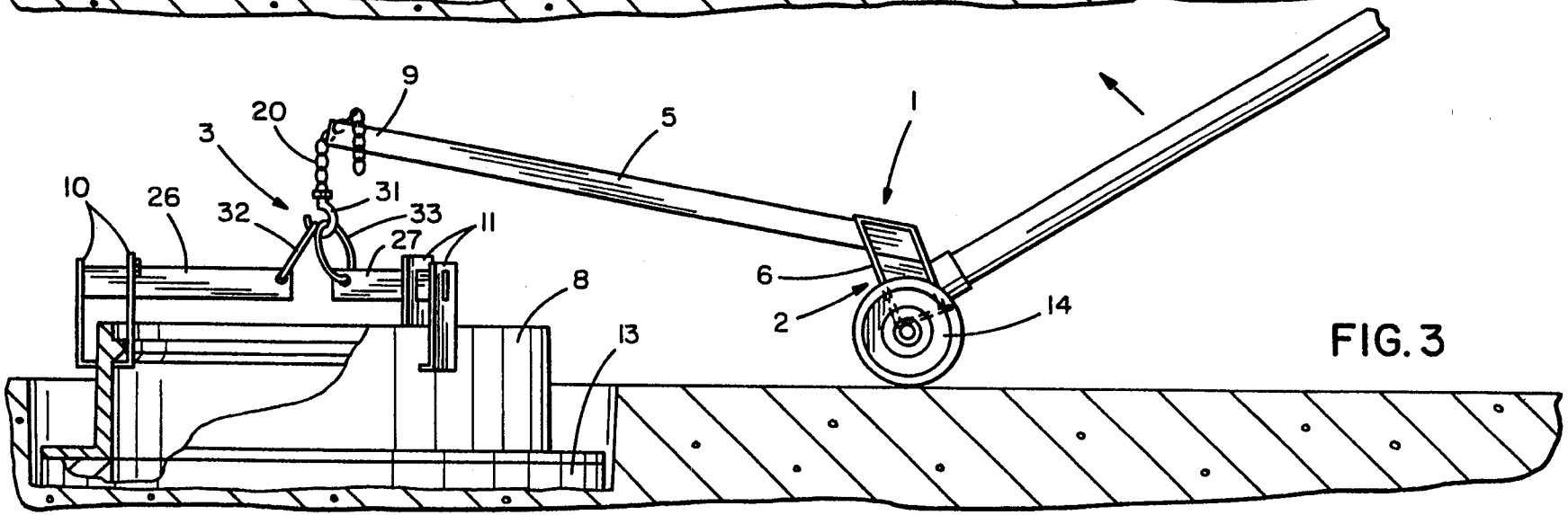
FIG. 3 is a view related to FIGS. 1 and 2 which shows the manhole frame seated in position relative to the manhole.

The mechanical advantage and the ease which tool 1 can be moved enable a single human operator to lift, move, and lower a heavy object that may weigh several hundred pounds. In FIG. 1, manhole frame 8 may typically weigh 300 pounds or more so manual movement and placement requires several individual operators to effect proper placement on top of cylindrical manhole wall 13 (FIG. 3).

Wheels 14 and 15 are carried on axel 16 (FIGS. 4–7), and metal carriage frame 17 is supported on axel 16 and is capable of a tilting or pivoting movement relative to the axel so that an object, such as a manhole frame 8, can be raised and lowered by an opposite manual force applied to the projecting end 7 of operating arm 4.

Carriage frame 17 is formed to provide a first socket 18 having a circular bore which receives the carriage-engaged end of operating arm 4 with a tight friction fit. The frame also includes a second socket 19 (FIG. 7) having a square bore which receives the carriage engaged end of boom 5 with a tight friction fit. Arm 4 and boom 5 are fabricated of metal and are of unequal lengths typically several feet long. The selected lengths of arm 4 and boom 5 should provide sufficient mechanical advantage to enable easy lifting and lowering of a heavy object. In general, the longer the length of operating arm 4 and the shorter the length of boom 5, the greater the mechanical advantage. Each increment of length of boom 5 defeats or nullifies the ability of an equal length of arm 4 to provide mechanical advantage. Accordingly, the active lever length of boom 5 should only be long enough to prevent the object being moved from striking carriage 6. This guideline can be accomplished by having several booms 5 each with a different length, or alternatively by fabricating boom 5 so that carriage assembly 3 can be attached to boom 5 at several selectable points along its length.

Figure 8:
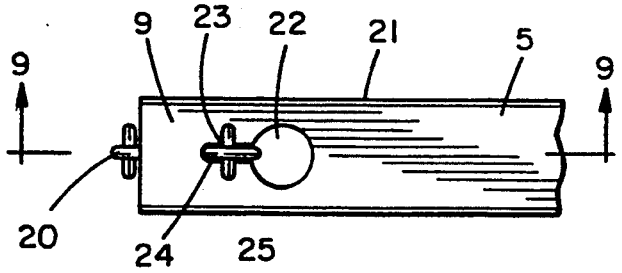
FIG. 8 is a fragmentary view which shows the clamp chain coupled and locked to the projecting end of the boom.
Figure 9:
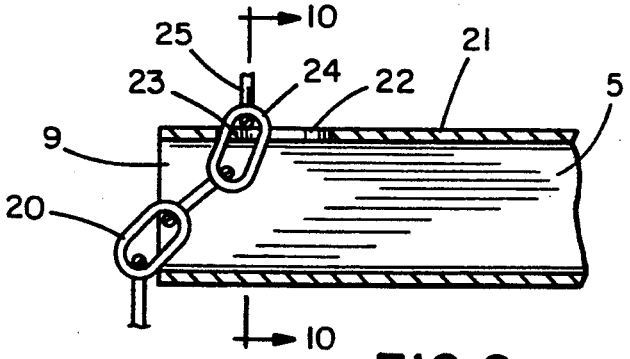
FIG. 9 is a section view taken along line 9—9 of FIG. 8 which shows details of the structure by which the clamp chain is locked to the boom.
Figure 10:
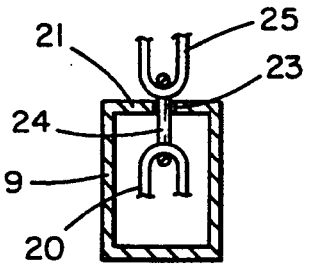
FIG. 10 is a section view taken along line 10—10 of FIG. 9 which shows another view of the structure which locks the clamp chain to the boom.

Clamp assembly 3 is coupled to projecting end 9 of boom 5 by link chain 20 (FIGS. 8, 9 and 10). Boom 5 is formed from rectangular metal stock having a hollow bore. The upper sidewall 21 of boom 5 is formed with a composite aperture which has a circular hole 22 communicating with a slot 23. Chain 20 is locked to boom 5 by feeding chain 20 through circular hole 22 and engaging an appropriate link 24 in slot 23 with the upper adjacent link 25 locking link 24 in slot 23 (FIG. 10).

Each of jaw sets 10, 11 and 12 is carried on individual support arms 26, 27 and 28, respectively.

Figure 11:
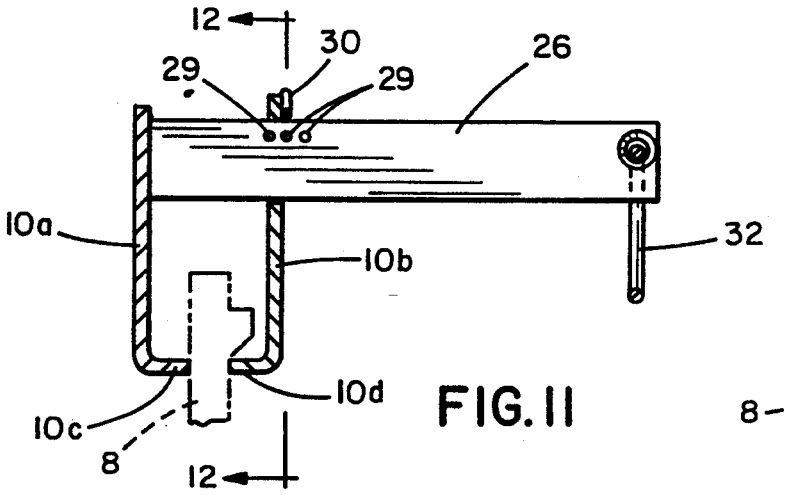
FIG. 11 is a section view taken along line 11—11 of FIG. 4 which shows a clamp arm and its associated jaws engaging the annular wall and its lid-support shoulder of a manhole frame.
Figure 12:
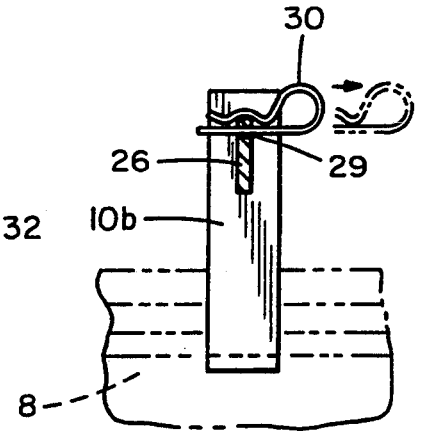
FIG. 12 is a section view taken along line 12—12 of FIG. 11 which shows the jaw locking clip.
Figure 13:
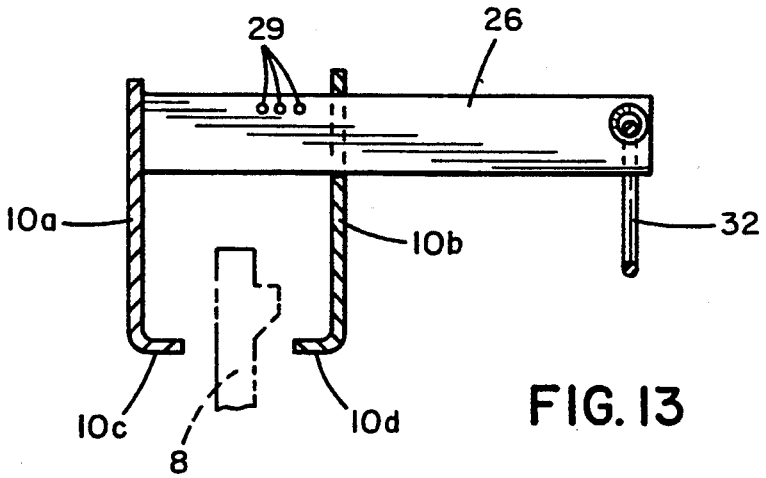
FIG. 13 is a view related to FIG. 11 which shows the jaws disengaged from the manhole frame.

All jaw sets and their support arms are identical in construction. Accordingly, this construction is described with reference to jaw set 10 (jaws 10*a* and 10*b*) and its support arm 26 (FIGS. 11, 12 and 13). Individual jaw 10*a* is welded to the end of support 26; and individual jaw 10*b* rides on support arm 26 by forming that jaw with an elongated hole that can receive with ease its associated support arm 26. Support arm 26 is formed with a series of small holes 29 which are sized to receive locking clip 30 (FIGS. 11 and 12).

In operation, locking clip 30 is inserted in the appropriate hole 29 (FIG. 11) to hold jaw lips 10*c* and 10*d* in tight engagement with manhole frame 8 (or any other heavy object being handled).

Figure 4:
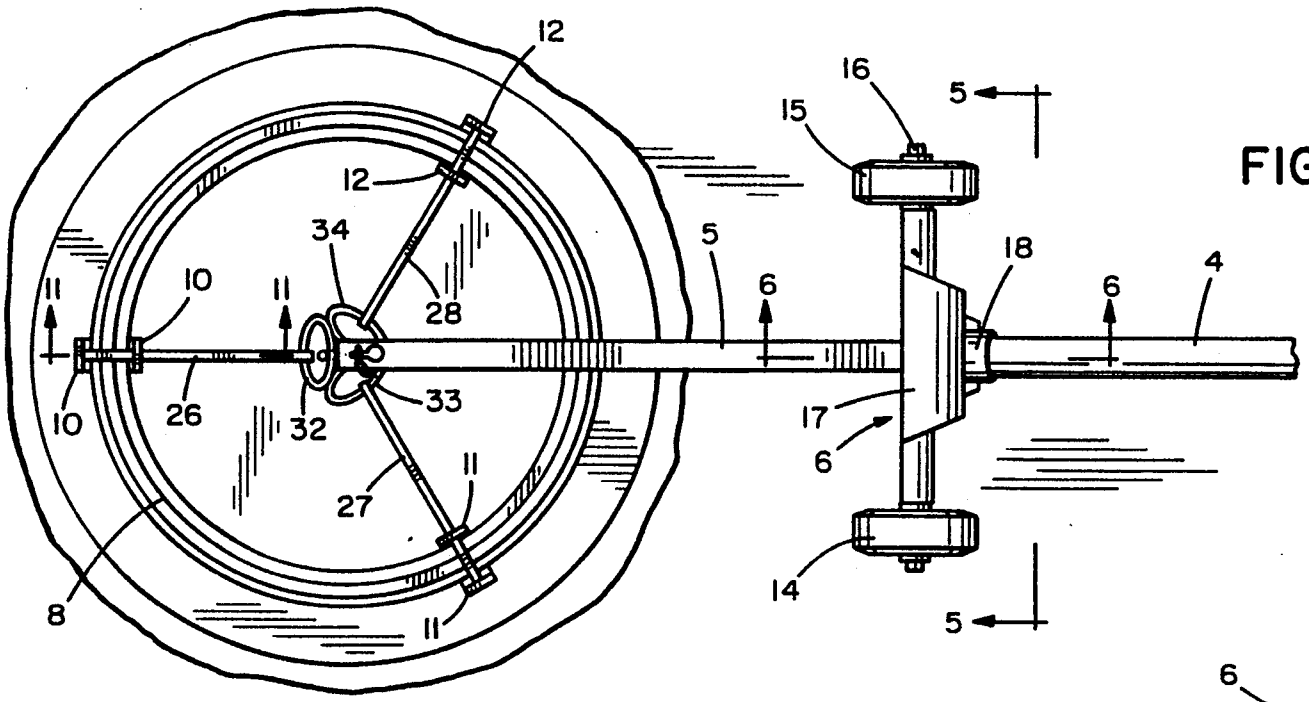
FIG. 4 is a plan view of the structure of FIGS. 2 and 3.
Figure 5:
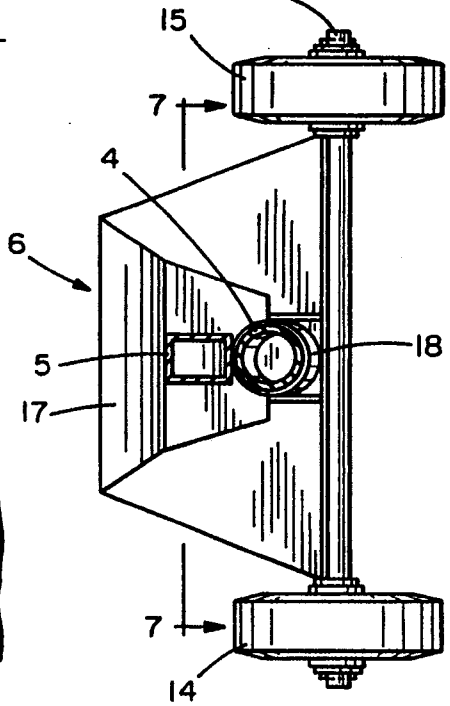
FIG. 5 is a section view taken along line 5—5 of FIG. 4, which shows in elevation details of the carriage assembly.
Figure 7:
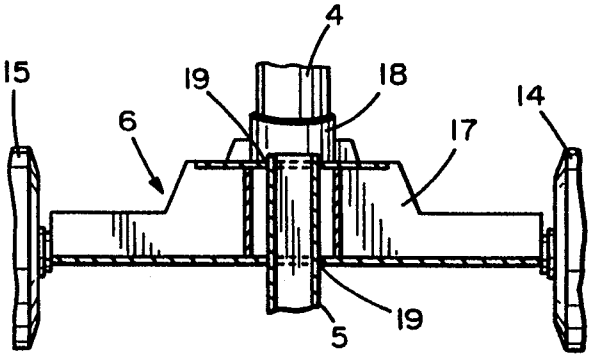
FIG. 7 is a section view taken along line 7—7 of FIG. 5 which shows additional details of the carriage assembly.
Figure 6:
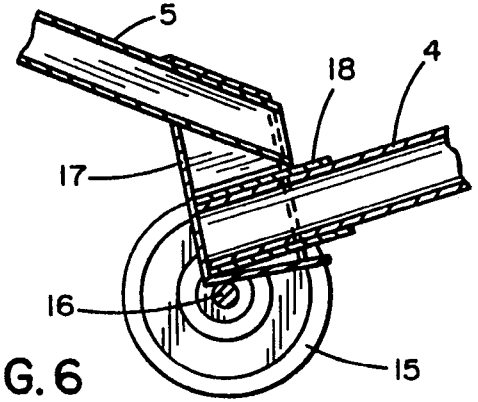
FIG. 6 is a section view taken along line 6—6 of FIG. 4 which shows details of the carriage sockets for receiving the operating arm and the boom which carries the clamp assembly.

The lower end of chain 20 carries a hook 31 which engages rings 32, 33 and 34 (FIG. 4). Rings 32, 33 and 34 are connected to support arms 26, 27 and 28 respectively.

Accordingly, when operating arm 20 is manipulated, any heavy object engaged by jaw sets 10, 11 and 12 can be lifted, moved and lowered with sufficient mechanical advantage to reduce greatly the stress that a human operator would otherwise be subjected to.

It should be understood that the above described embodiment merely illustrates a preferred structural embodiment of my invention, and that modifications can be made without departing from the scope of my invention.

What is claimed is:

1. A carriage supported tool for manipulating a heavy object comprising: a mobile carriage assembly including a movable carriage which has a frame, a set of wheels supporting the frame, an operating arm, a clamp-assembly support boom with both the arm and the boom attached to the carriage and projecting from the carriage in different directions on opposite sides of the frame upwardly from the carriage frame in a common vertical plane when the set of wheels is resting on a horizontal plane; a clamp assembly coupled to the boom and including a plurality of spaced jaw sets for engaging a heavy object which is to be moved with each of the plurality of jaw sets being angularly spaced from the other jaw sets when the heavy object is engaged for manipulation by manual handling of the operating arm; a jaw-set support arm for each jaw set with each jaw set having a first jaw fixed to its associated support arm and a second jaw adjustably movable relative to both its associated support arm and its associated fixed jaw and in which each jaw-set support arm is elongated and radially and angularly disposed relative to the other support arms and in which each jaw set is positioned at an outer end of its associated support arm; and coupling means engaging the inner ends of all of the support arms and connecting those ends to the boom, in which the coupling means is a chain and a hook and a plurality of loops, each of said loops connected between said hook and one of said arms.

2. The tool of claim 1 in which each jaw is generally L-shaped in configuration and includes an object engaging lip formed at an end of the jaw spaced from the support arm for that jaw.

3. The tool of claim 2 in which the engaging lip of each jaw is closely aligned with the engaging lip of the other jaw of its jaw set to establish a clamping bight on an object to be manipulated by the tool.

4. The tool of claim 3 having three jaw sets which define three clamping bights located on a circular locus when the jaw sets are clamped upon a cylindrical object.

5. A carriage supported tool for manipulating a heavy object comprising: a mobile carriage assembly including a movable carriage which has a frame, a set of wheels supporting the frame, an operating arm, a clamp-assembly support boom with both the arm and the boom attached to the carriage and projecting from the carriage in different directions on opposite sides of the frame and upwardly from the frame in a common vertical plane when the set of wheels is resting on a horizontal plane; a clamp assembly coupled to the boom including a plurality of spaced jaw sets with each set having a pair of jaws for engaging a heavy object which is to be moved with each of the plurality of jaw sets being angularly spaced from the other jaw sets when the heavy object is engaged for manipulation by manual handling of the operating arm; and a jaw-set support arm for each jaw set with each jaw set having a first jaw fixed to an outer end of its associated support arm and a second jaw adjustably and slidably movable on an intermediate portion of its associated support arm and relative to its associated first jaw with each jaw-set support arm being elongated and radially and angularly disposed relative to the other support arms and in which each jaw set is positioned at an outer end of its associated support arm when the heavy object is engaged; an object engaging lip formed at an end of each jaw spaced from the support arm for that jaw creating an L-shaped jaw configuration and in which the engaging lip of each jaw is closely aligned with the engaging lip of the other jaw of a jaw set to establish a clamping bight on an object to be manipulated by the tool; and coupling means engaging the inner ends of all of the support arms and connecting those ends to the boom.

* * * * *